US009510698B1

(12) United States Patent
Krotova

(10) Patent No.: US 9,510,698 B1
(45) Date of Patent: Dec. 6, 2016

(54) BED SHEET SYSTEM

(71) Applicant: Zhanna Krotova, Powell, TN (US)

(72) Inventor: Zhanna Krotova, Powell, TN (US)

( * ) Notice: Subject to any disclaimer, the term of this patent is extended or adjusted under 35 U.S.C. 154(b) by 0 days.

(21) Appl. No.: 15/188,278

(22) Filed: Jun. 21, 2016

Related U.S. Application Data

(63) Continuation-in-part of application No. 14/313,125, filed on Jun. 24, 2014.

(51) Int. Cl.
*A47G 9/04* (2006.01)
*A47G 9/02* (2006.01)

(52) U.S. Cl.
CPC ..... *A47G 9/0246* (2013.01); *A47G 9/04* (2013.01)

(58) Field of Classification Search
CPC ..... A47G 9/04
USPC ..... 5/482, 486, 495–497
See application file for complete search history.

(56) References Cited

U.S. PATENT DOCUMENTS 2,757,389 A * 8/1956 King ..... A47G 9/0246 5/496
3,083,379 A * 4/1963 Marinsky ..... A47G 9/0246 5/496
3,243,827 A * 4/1966 Kintner ..... A47G 9/0246 5/482
4,045,832 A 9/1977 DiForti et al.

(Continued)

FOREIGN PATENT DOCUMENTS

GB 2292075 A 2/1996

*Primary Examiner* — Fredrick Conley
(74) *Attorney, Agent, or Firm* — Luedeka Neely Group, PC

(57) ABSTRACT

A bed sheet system for application to a mattress having rounded corners, a nominal mattress width between opposite sides of mattress, a nominal mattress length between opposite ends of the mattress, and a nominal mattress height. The bed sheet system includes a bottom flat fitted sheet and standard dimension top unfitted sheet. The unfitted top sheet may be attached by fastening along the foot-hem to the bottom sheet, or not attached with placement head-mark and size-mark, and corners marks to guide properly centered position with proper amount overhang on the sides and ends. The bottom flat-fitted sheet includes a rectangular material without cutouts or with cutouts at corners of the sheet on intersection of reference lines, and which according to the calculation, has geometric layout including a central part designed according to calculations to cover top of mattress, where length and width of central part are smaller two inches, than nominal length and width of mattress, because arches as ⅛ of circle with approximately five inches radius are smaller one inch compere to five inches radius of mattress's corners. Because the physical edge of mattress is eight inches (2π×5" radius of mattress/4=8") smaller than sum of nominal rectangular mattress' dimensions, the central part has been established by calculation as rectangular, which perimeter is equal curved border of mattress and is depicted in reference lines. The central part is surrounded by two ends and two sides for overhang ends and sides of mattress, which heights are one inch bigger than height of mattress designed for one inch of reinforced hem on the perimeter of bottom fitted sheet for the placement of fasteners at the tension points as offset to the reference lines, and when pulling with force together the fasteners causes reinforced hem to slip under corners of mattress, and keeps the sheet on the mattress without slipping off. The size and dimension of a fitted bed sheet are determined for each of various sizes of mattress by calculation for the central part and height of the mattress with addition one inch for the reinforced hem.

1 Claim, 19 Drawing Sheets

(56) References Cited

U.S. PATENT DOCUMENTS

| | | | | |
|---|---|---|---|---|
| 4,144,602 | A | 3/1979 | Fernandes | |
| 8,015,636 | B2 | 9/2011 | Bolish et al. | |
| 2008/0028522 | A1* | 2/2008 | Atwood | A47G 9/0246 5/496 |
| 2012/0124741 | A1 | 5/2012 | Okresik et al. | |
| 2012/0317723 | A1 | 12/2012 | Liversage et al. | |

* cited by examiner

Total Length of mattress RIM is EQUAL sum of Length of Central Part of SHEET

(2x12W+2x12L) - (5"-1/8x2x3.14x5")x8 = (2x34W+2x34L)

W= (12W-2x1")+(12H+1"+12H+1") = (34W+2x12H+2")

L = (12L-2x1")+(12H+1"+12H+1") = (34L+2x12H+2")

Total Length of mattress RIM is EQUAL sum of Length of Central Part of SHEET (2x12W+2x12L) - (5"-1/8x2x3.14x5")x8 = (2x34W+2x34L)

BED SHEET SYSTEM

CROSS-REFERENCE TO RELATED APPLICATIONS

This application is a continuation-in-part of co-pending U.S. application Ser. No. 14/313,125, filed Jun. 24, 2014, incorporated by reference herein in its entirety.

FIELD

This disclosure relates generally to a bed sheet system. More particularly, this disclosure relates to a bed sheet system configured to include a fitted sheet and a flat sheet configured for improved fit and ease of installation onto a mattress.

BACKGROUND

The present disclosure relates to system and methods by using flat sheets for bed covering in desired position on the mattress. Conventional bedclothes system of the top flat sheet and bottom fitted sheet for mattresses desire improvement.

Attempts in the prior art to provide fitted sheets differ from the present invention, which utilizes a non-elastic material (sheet) configured to compress the mattress in three dimensions. Prior attempts do not apply tensions in three dimensions and/or utilize elastic to try to fit and compress the sheet to the shape of the mattress One prior attempt involves trying to accomplish accurate sheet coverage based on the physical shape of mattress without applying strong tensions in three dimensions for the compression on the mattress body. For example, U.S. Pat. No. 3,083,379 shows a structure, in which is full size copy of the top of mattress and the corners of the sheet are cut away to facilitate conforming of the arch corner to the underlying mattress. U.S. Pat. No. 2,757,389 shows a similar structure having the contour of underlying mattress with cut away corners for accurate wrapped mattress. Other examples include the sheets of U.S. Pat. Nos. 4,144,602; 2,462,156; and 3,243,827.

Another attempt is to round the corners of the sheet and to insert an elastic tension member in the periphery of each corner, or all around the periphery of the sheet. This results in a bed sheet, which fits the mattresses with a slightly different height. An example of this is shown in U.S. Pat. No. 5,177,821. Conventional fitted sheets along this design are configured to include formed corner pockets and a continuous elastic member for maintaining the corner pockets on the corners of the mattress. Such conventional fitted sheets are difficult to iron, fold and stack, and are also difficult to install. Installation typically requires lifting of the mattress to install each corner, especially for larger and heavier mattresses such as king sized mattresses. In the case of repeated sheet changes, such as is performed by those the hotel industry, this can cause undue body strain and the like.

Laundering of conventional fitted sheets is also problematic. For example, repeated laundering tends to destroy the elasticity of the elastic members. Also, the pockets tend to cause the sheets to collect other laundry items and cause a ball that detrimentally affects cleaning of the sheets and other items during washing and also drying of the sheets of other items.

Accordingly, improvement is desired in the construction of fitted sheets. The present disclosure advantageously provides flat fitted sheets of improved construction that avoid many of the shortcomings of conventional fitted sheets.

The flat fitted sheets according to the disclosure are easier to install onto a mattress and avoid lifting of the mattress. In addition, sheets according to the disclosure tend to fit and remain installed on a mattress better than conventional sheets, and are easier to iron, fold, and store.

Another aspect of the present invention relates to a structure having a top unfitted sheet fastened or attached to a fitted sheet. Prior art attempts to solve the problem solved by Applicant do not provide a similar structure or function. These attempts involve modification of standard bedclothes and methods of bed-making which desire improvement.

For example, U.S. Pat. No. 5,099,531 discloses a method wherein bottom sheet together with top sheet are to attached to mattress by fasteners. U.S. Pat. No. 7,086,102 discloses a method of making bed where top fabric cowering is permanently attached by stitching to the bottom sheet at the foot region of the bottom sheet which have elastic bands. U.S. Pat. Nos. 4,040,133; 5,042,099; and 3,832,743 disclose hook/loop attachment of a top sheet to a bottom bed sheet. U.S. Pat. No. 5,099,531, shows the use of buttons firmly attached along the foot end of mattress. The bedclothes are likewise anchored to the mattress, either all around, or at least along the foot end of the mattress. The buttons or fasteners attached to the mattress are readily visible, which is undesirable. U.S. Pat. No. 5,321,862, discloses a method of making bed where bedclothes which have been modified by affixing thereto connectors which are positioned to guide the placement of bedclothes on the mattress by using multiple connectors permanently attached which can be snaps and receivers or hook-and-loop type fasteners and will be in contact with and uncomfortable for a sleeping person. U.S. Pat. No. 8,635,724 utilizes buttons to connect the bottom and top sheet. The buttons are sewed on the head and foot ends portions of the bottom fitted sheet, and button holes are provided spaced from the foot end of top sheet a pre-selected distance; widthwise-intervals that match the location of the buttons on the bottom fitted sheet.

The present invention also advantageously provides a system having identification marks of the underlying mattress, as well as size marker and head marker on the head-end of the sheet. This is advantageous for facilitating installation of sheets. Conventional system of top flat sheet and bottom fitted sheet do not have identification marks of the underlying mattress, as well as size and head markers on the head-end of the sheet. The present disclosure also provides identification marks of the underlying mattress, as well as size marker and head marker on the head-end of the sheet.

Another advantage of the present invention over the prior art is that the present invention provides a system for making quickly coupled together top and bottom sheets and making separation as required in short time. According to the preferred embodiment buttons on the twill tape or double-sided button are be used to connect top flat standard size sheet and bottom fitted sheet thru button holes located on the foot-ends of reinforced perimeters. Top and bottom sheets can be laundered and stored separate.

SUMMARY

The disclosure advantageously provides a bed sheet system for application to an elastic mattress having rounded corners, a nominal mattress width between opposite sides of the mattress, a nominal mattress length between opposite ends of the mattress, and a nominal mattress height.

In one aspect, the bed sheet system includes a top unfitted sheet with standard dimensions, and bottom flat fitted sheet having a rectangular shape. Unfitted top sheet may be attached by fastening row or not attached along the foot-hem to the bottom fitted sheet, with placement of head-mark and size-mark, and corners marks to guide properly centered position with proper amount overhang on the sides and ends.

The bottom sheet is a flat-fitted Sheet including a rectangular material without cutouts or with cutouts at corners of the sheet on intersection of reference lines, which according to the calculation, has geometric layout including a central part designed according to calculations to cover the top of the mattress. The length and the width of the central part are smaller two inches than the nominal length and width of the mattress, because arches as ⅛ of circle with approximately five inches radius are smaller one inch compere to five inches radius of mattress's corners.

Because the physical edge of mattress is eight inches (2×3.14×5" radius of mattress/4=8") smaller than sum of the nominal dimensions of the rectangular mattress, the central part has been established by calculation as rectangular, which perimeter is equal curved border of mattress, and depicted in reference lines. The central part is surrounded by two ends and two sides for overhang ends and sides of mattress, which heights are one inch bigger than height of mattress designed for one inch of reinforced hem on the perimeter of the sheet to slip under the corners of the mattress, when pulling with force together the fasteners.

The size and dimension of the flat-fitted sheet are determined for each of various sizes of mattress by calculation for the central part and the height of the mattress with addition one inch for the reinforced hem.

A rectangular central part of the fitted sheet is defined and confined by the reference lines and further corresponding to a reduction of two inches of the nominal width and length dimensions of the mattress, the central part having a perimeter equal to a perimeter of a physical top of the mattress; the reference lines of the central part defining positions for location of fasteners and the lines of any cutouts at corners of the sheet material. The system includes plurality of fasteners, at least one fastener positionable adjacent each corner of the mattress and fastenable to the sheet material at locations corresponding to the reference lines to fit the fitted sheet snugly to the mattress.

The fitted sheet is installed and snugly fit onto the mattress by applying pressure to the fitted sheet by pulling to secure the fasteners in position on the reinforced hem of the sheet. Application of the pressure by pulling causes the length of curved edges of the physical top of the mattress to transform to the rectangular shape of the central part of the fitted sheet. This creates three dimensional compression of the mattress and tension made on the reinforced hem by a pulled force applied by the fasteners to provide additional tension around the elastic mattress to cause lower edges of the fitted sheet to slip under the mattress to aid in maintaining the fitted sheet in compression on the mattress and aid in inhibiting the fitted sheet from slipping off the mattress.

It has been discovered that the cooperating structure of the sheet and location of the fasteners at or behind the reference lines results in a fitted sheet dimensioned smaller than the mattress. The mattress has curved corners and is elastic and the mattress is compressed slightly during installation of the fitted sheets. After installation, the expansion of the mattress from its compressed state serves to fit the mattress tightly within the confines of the installed not-elastic fitted sheet. It has been discovered that this provides advantages as compared to conventional fitted sheets which themselves incorporate elastic. Quite to the contrary, fitted sheets according to the disclosure are not elastic in this manner and instead utilize the elasticity of the mattress to provide the desired snug and custom fit.

The top unfitted sheet may have standard dimensions for various mattresses and may be attached by fastening row along the foot-hem to the bottom fitted sheet, or not attached. The unfitted sheet includes placement of head-marker, size-marker and corners-markers to guide properly centered position with proper amount overhangs on the sides and ends.

BRIEF DESCRIPTION OF THE DRAWINGS

Further advantages of the disclosure are apparent by reference to the detailed description in conjunction with the figures, wherein elements are not to scale so as to more clearly show the details, wherein like reference numbers indicate like elements throughout the several views, and wherein:

FIG. 19 shows an embodiment of attached sheets according to the disclosure.

FIG. 20 shows embodiment of not-attached sheets according to the disclosure.

DETAILED DESCRIPTION

Figure 14:
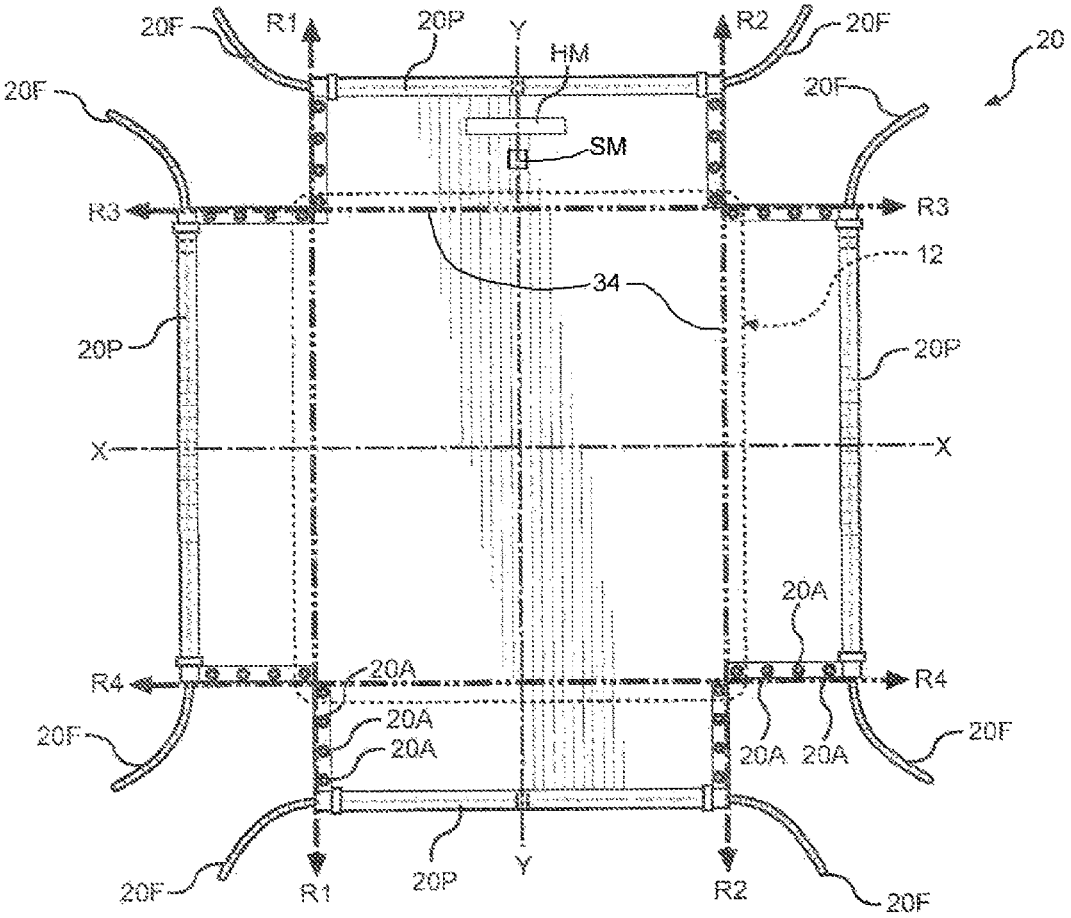
FIG. 14 is a plan view of an alternate embodiment of a fitted sheet having cut-out corners according to the disclosure.

With reference to the drawings, the disclosure relates to a bed sheet system 10 according to the disclosure for use with a mattress 12. The bed sheet system 10 includes a bottom fitted sheet configured to be fit snugly onto the mattress 12, such as a fitted sheet 14 (FIG. 3), a fitted sheet 16 (FIG. 7), a fitted sheet 18 (FIG. 11), or a fitted sheet 20 (FIG. 14). The bed sheet system 10 also includes a standard dimension top unfitted flat sheet 22 (FIG. 16) compatible with the mattress 12 and can be attached or not-attached to the bottom fitted sheets 14/16/18/20.

With reference to FIGS. 1, 1A, 1B, 1C, the mattress 12 has the four rounded corners 12C. Each of the corners 12C is an arch corresponding to ¼ of a circle C having the radius 12R of 5 inches. It has been observed that nominal dimensions are not accurate for the physical shape of the mattress. That is, due to the curvature the length of the perimeter of the top of mattress is not the same as the nominal perimeter (nominal length of mattress×2)+(nominal width of mattress×2). It has also been observed that mattresses are relatively elastic and that this elasticity can be utilized to facilitate a snug fit of the fitted sheets according to the disclosure In this regard, it has been observed that each half of each of the rounded corners 12C substantially corresponds to a segment S corresponding to ⅛ of the circumference of the circle C having a radius 12R. The circumference of the circle C is determined by the formula: 2 πr, where r corresponds to the radius 12R of the circle C. As used herein, 3.14 is sometimes utilized in place of π.

Accordingly, for a radius 12R of 5 inches, the perimeter is 32 inches, and ⅛ of the perimeter is 4 inches, such that S is equal to πr/4. As will be observed in FIG. 1A, the nominal width 12W and the nominal length 12L of the mattress 12 is greater by a difference D at each end than the width and length determined taking into account the curved segments S, resulting in a total difference of 2D. As will be noted, the distance D deducted from each end and width of the nominal width and length of the mattress 12 corresponds to the reference lines R1-R4. The distance D is thus the radius 12R minus the segment S. That is, D equals the r−πr/4=1 (where r equals the radius 12R).

Thus, each of the width reference lines R1 and R2 is selected so as to be parallel to one the sides of the mattress and spaced a distance inside a side of the mattress an amount of at least the difference of the radius r of the mattress minus πr/4. Likewise, each of the length reference lines R3 and R4 is being selected so as to be parallel to one of the ends of the mattress and spaced a distance inside an end of the mattress an amount of at least the difference of the radius r of the mattress minus πr/4.

For the provided dimensions, the difference of the radius r of the mattress minus πr/4 is equal to 5 inches−4 inches=1 inch. Hence, for the fitted sheets 14/16/18/20, the reference lines R1 and R2 are each located one inch inside of the respective sides of the mattress 12 when the sheet is applied to the mattress. The reference lines R3 and R4 are each located one inch inside of the respective ends of the mattress 12 when the sheet is applied to the mattress.

As will be observed, locating the fastening devices of the sheets at tension points on the reinforced hem of the bottom flat-fitted sheet, as the set of three tension points, being offset in distance one inch, and next one inch apart respectively off the reference lines R1-R4 interior, results in a fitted sheet dimensioned smaller than the mattress. However, since the mattress is elastic, the mattress is compressed slightly during installation of the fitted sheets. After installation, the expansion of the mattress from its compressed state serves to fit the mattress tightly within the confines of the installed fitted sheet. It has been discovered that this provides advantages as compared to conventional fitted sheets which themselves incorporate elastic. Quite to the contrary, fitted sheets according to the disclosure are not elastic in this manner and instead utilize the elasticity of the mattress to provide the desired snug and custom fit.

The mattress 12 may be a conventional mattress having an upper surface 12U, a nominal width 12W, height 12H, a nominal length 12L, and four corners 12C. Each corner 12C has a radius of curvature 12R. This is discussed in more detail above in connection with FIG. 1A. The nominal width 12W and nominal length 12L of the mattress 12 are measures on the center lines of mattress as if the mattress 12 was rectangular with square corners instead of rounded corners.

Figure 1:
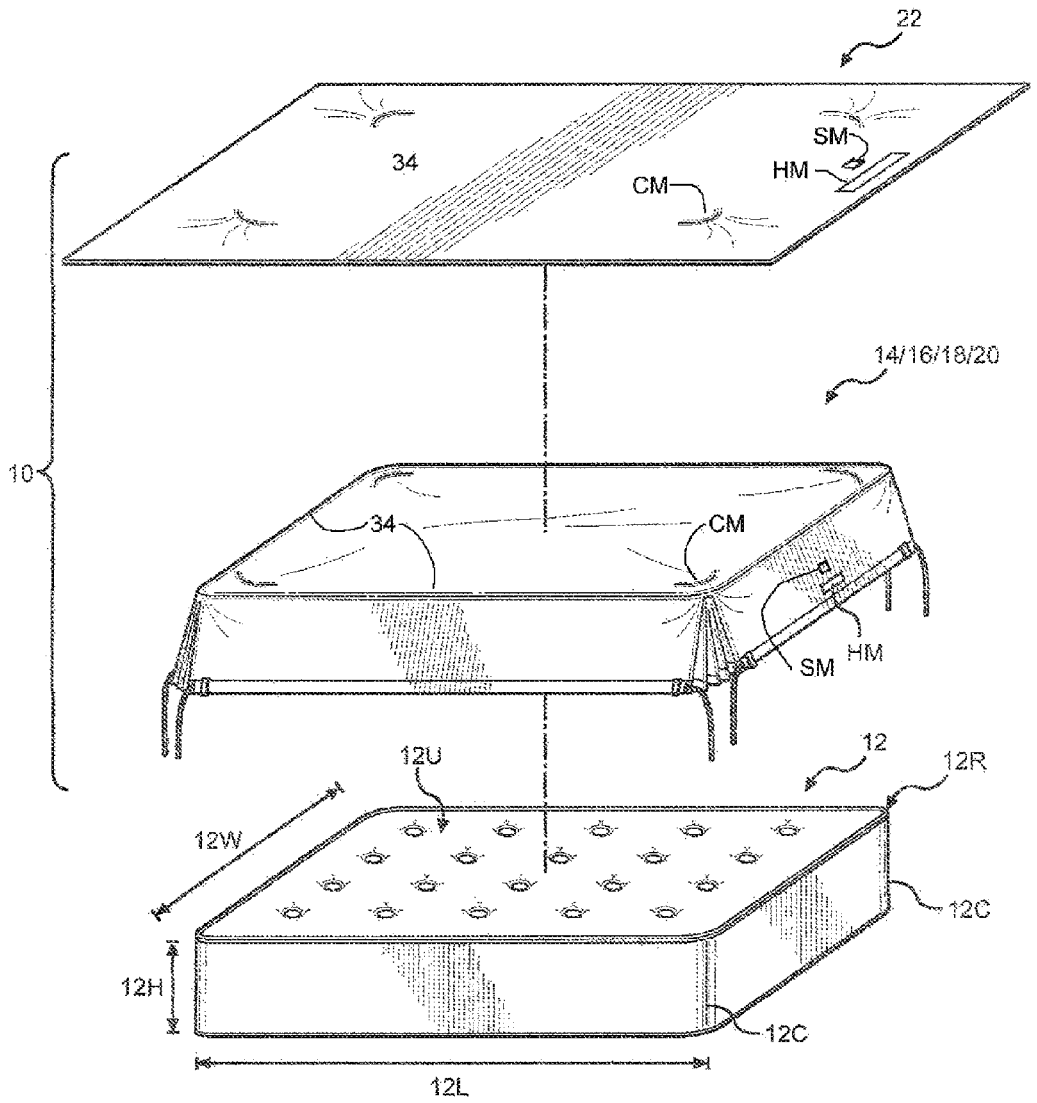
FIG. 1 is an exploded view of a bed sheet system according to the disclosure for installation onto a mattress.
Figure 1A:
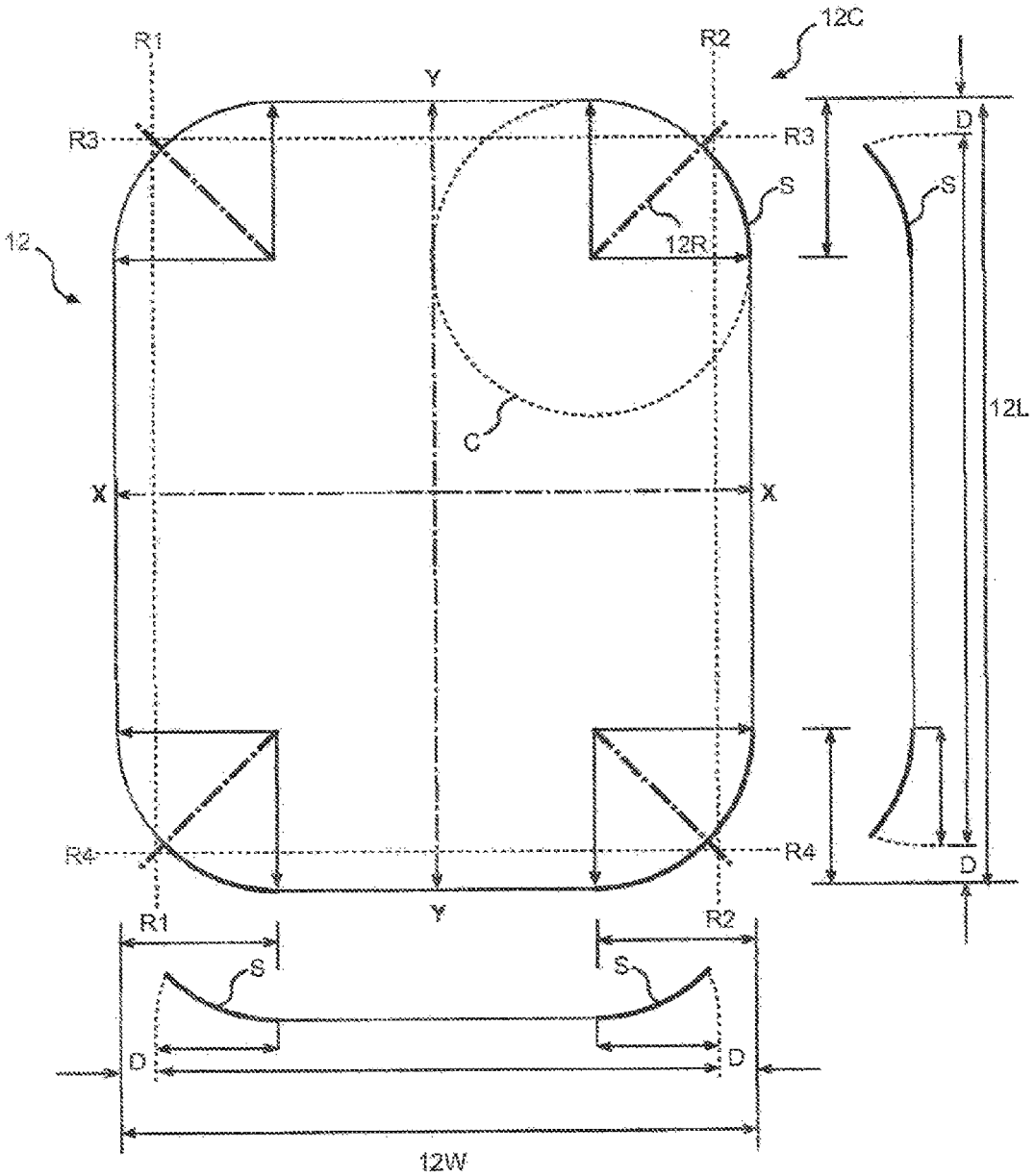
FIG. 1A, 1B, 1C are a top plan view of a mattress, showing the curves thereof and graphic illustration with calculations for central part of bottom fitted sheet.
Figure 1B:
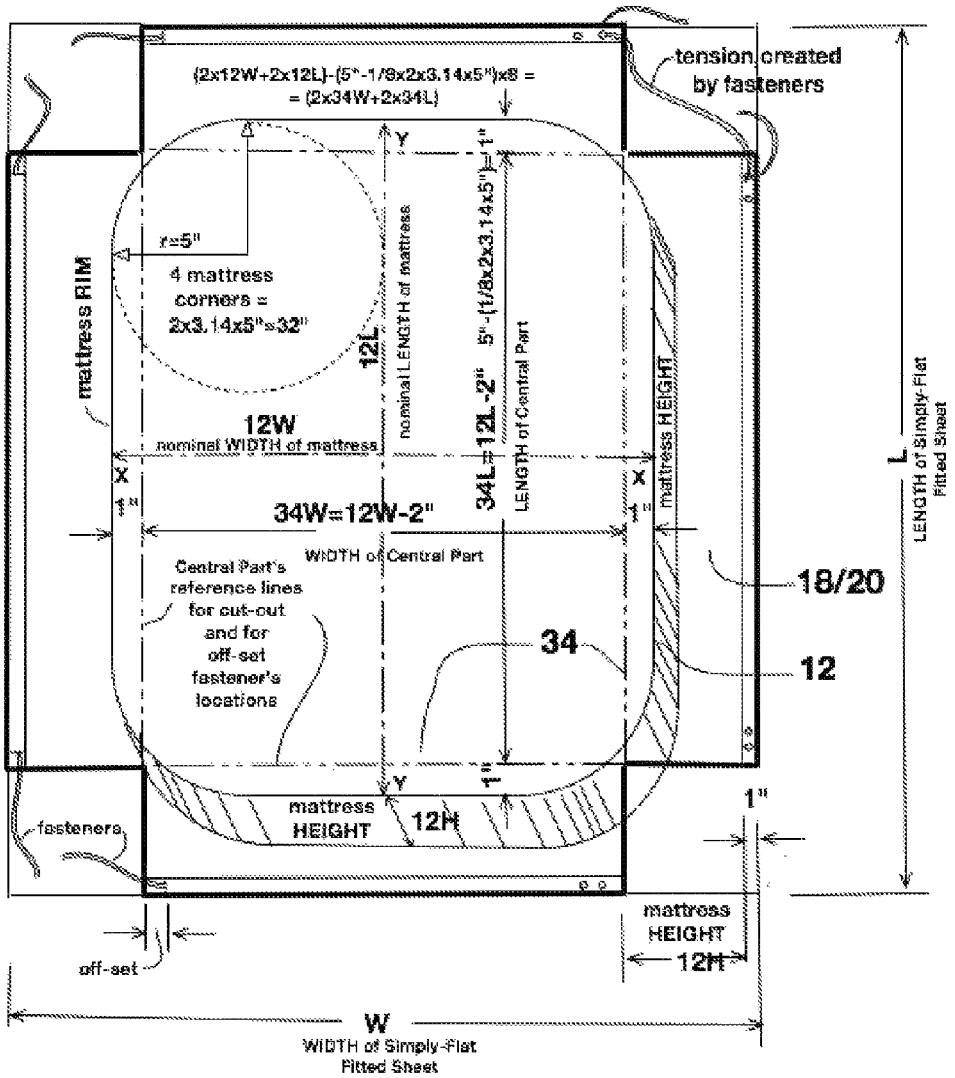
Figure 1C:
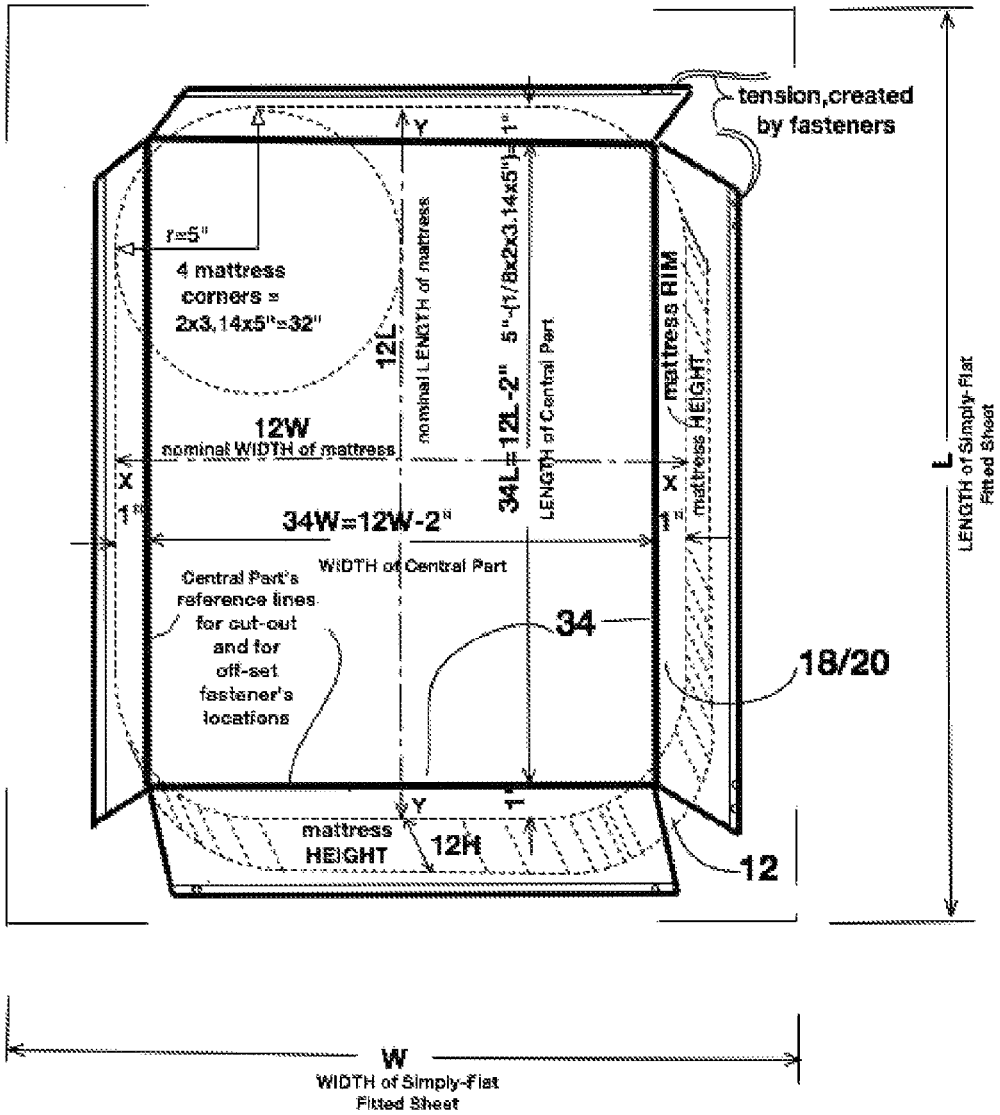

FIGS. 1A, 1B, 1C, discussed in more detail above, show the curves of the mattress and illustrate how the tension of the fitted sheets 14/16/18/20 is accomplished and construction thereof. Geometry formulas and calculations for the structure and size of the fitted sheets 14/16/18/20 and the relation to the nominal dimensions of the mattress are also shown. In this regard, it will be appreciated that one novel aspect of the flat fitted sheets in accordance with the disclosure relates to configuring the sheets, which are non-elastic, to fit onto and compress the elastic mattress to provide a perfect fit of the fitted sheet.

For the purpose of example, mattresses designated to be twin size typically have a nominal width of 39 inches and a nominal length of 75 inches. Full size mattresses have a nominal width of 54 inches and a nominal length of 75 inches. Queen size mattresses have a nominal width of 60 inches and a nominal length of 80 inches. King size mattresses have a nominal width of 76 inches and a nominal length of 80 inches. Mattresses typically have heights ranging from about 12 to about 18 inches.

Figure 2:
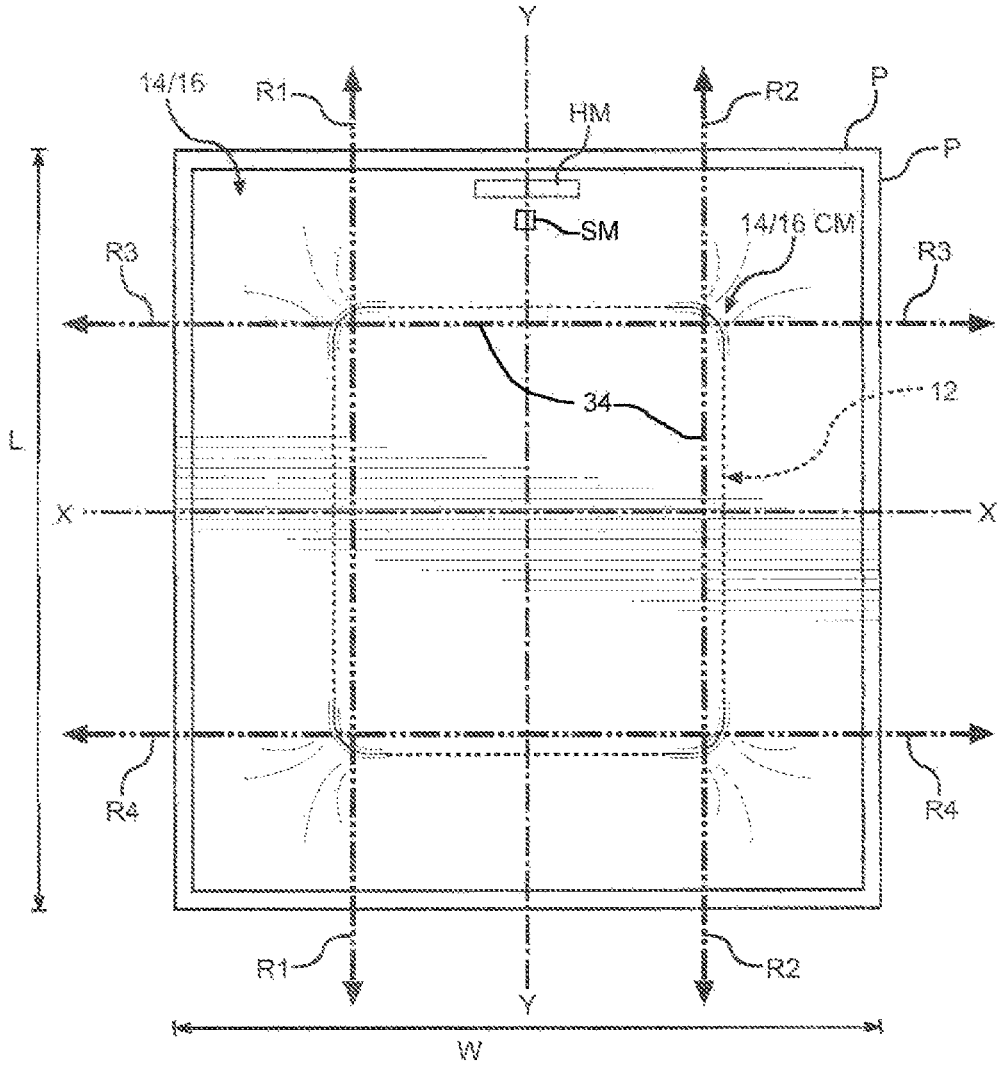
FIG. 2 is a general plan view of rectangular fitted sheets according to the disclosure showing sizing relationships relative to the mattress.

With reference to FIG. 2, the fitted sheets 14 and 16 are each configured to be substantially flat, rectangular, and dimensioned to be compatible with the mattress 12, and according to the calculation, have a geometric layout including a central part 34 depicted in reference lines, established by calculation (FIGS. 1A, 1B, 1C) as rectangular which perimeter, equal curved border of mattress, which function is to create compression on the body of elastic mattress by transformation curved top of mattress to rectangular. Reference lines are parallel to sides and ends of the mattress and spaced inside the borders of mattress a distance an amount one inch, which is the difference of the radius of the mattress's corners minus approximately four inches (3.14× radius of mattress/4), e.g. 5−3.93=1.

The length and width of the central part 34 are smaller by two inches, than the nominal length and width of mattress, because arches as ⅛ of circle with an approximately five-inch radius are smaller approximately one inch compared to the radius of the corners of the mattress. The central part 34 is surrounded by two ends and two sides of the sheet for overhang ends and sides of mattress, which heights are at least one inches bigger then height of mattress, designed for reinforced hem on the perimeter P of bed sheet.

The dimension of fitted bed sheets is determined for each mattress by calculating the size of the central part 34, and of the mattress height with an additional one inch for the perimeter P. The width W of the fitted bed sheet_is equal: width of central part (as nominal width of mattress 12W with reduction two inches) plus two times nominal height of mattress with addition two inches for reinforced perimeter P. The length L of the fitted bed sheet is equal: length of central part (as nominal length of mattress 12L with reduction two inches) plus two times nominal height of mattress with addition two inches for reinforced perimeter P.

The line X-X designates the lateral center line of the mattress 12 and the line Y-Y designates the longitudinal center line of the mattress 12. In use, the sheet 14/16 is initially positioned on the upper surface 12U of the mattress 12 so that the lateral center lines and the longitudinal center lines of the mattress 12 and the sheet 14/16 overlie one another.

As also shown in FIG. 2, the sheet 14/16 includes a reinforced perimeter P provided as by a hem or other reinforcing structure to reinforce the perimeter of the sheet 14/16, and particularly to rigidify the perimeter against stretching, and for aesthetics. The perimeter P preferably has a width of about one inch, and such dimension is included for each side and end of the sheet 14/16 in regards to the width W and length L of the sheet 14/16. Fasteners located at tension points on the reinforced hem of the bottom flat-fitted sheet, as the set of three tension points, being offset in distance one inch, and next one inch apart respectively off the reference lines interior. To aid identification in the desired orientation of the sheet 14/16, a size marker SM and head marker HM are located on the sheet adjacent a head end of the sheet 14/16. Likewise, the fitted sheets 18/20 and the flat sheet 22 also include the head marker HM and size marker SM.

Also with reference to FIG. 2, there are shown reference lines R1, R2, R3, and R4, which establish the central part of the fitted bed sheet. The reference lines R1 and R2 are each located (relative to the mattress 12 when the sheet 14/16 is centered on the mattress 12) one inch inside of the respective sides of the mattress 12, so that they are spaced apart a distance of two inches less than the nominal width 12W of the mattress 12. The reference lines R3 and R4 are each located (relative to the mattress 12 when the sheet 14/16 is centered on the mattress 12) one inch inside of the respective ends of the mattress 12, so that they are spaced a distance of two inches less than the nominal length 12L of the mattress 12.

Use of the reference lines R1-R4 is provided with the descriptions of the fitted sheets 14 and 16, and also in connection with FIG. 1A above relating to the actual rounded and elastic configuration of the mattress 12. The reference lines R1-R4 are not typically visible or marked on the sheet 14/16, but, are provided on FIG. 2 to indicate locations on the sheet 14/16 (relative to the mattress 12 when the sheet 14/16 is centered on the mattress 12) for location of certain features, as described more fully below.

Figure 3:
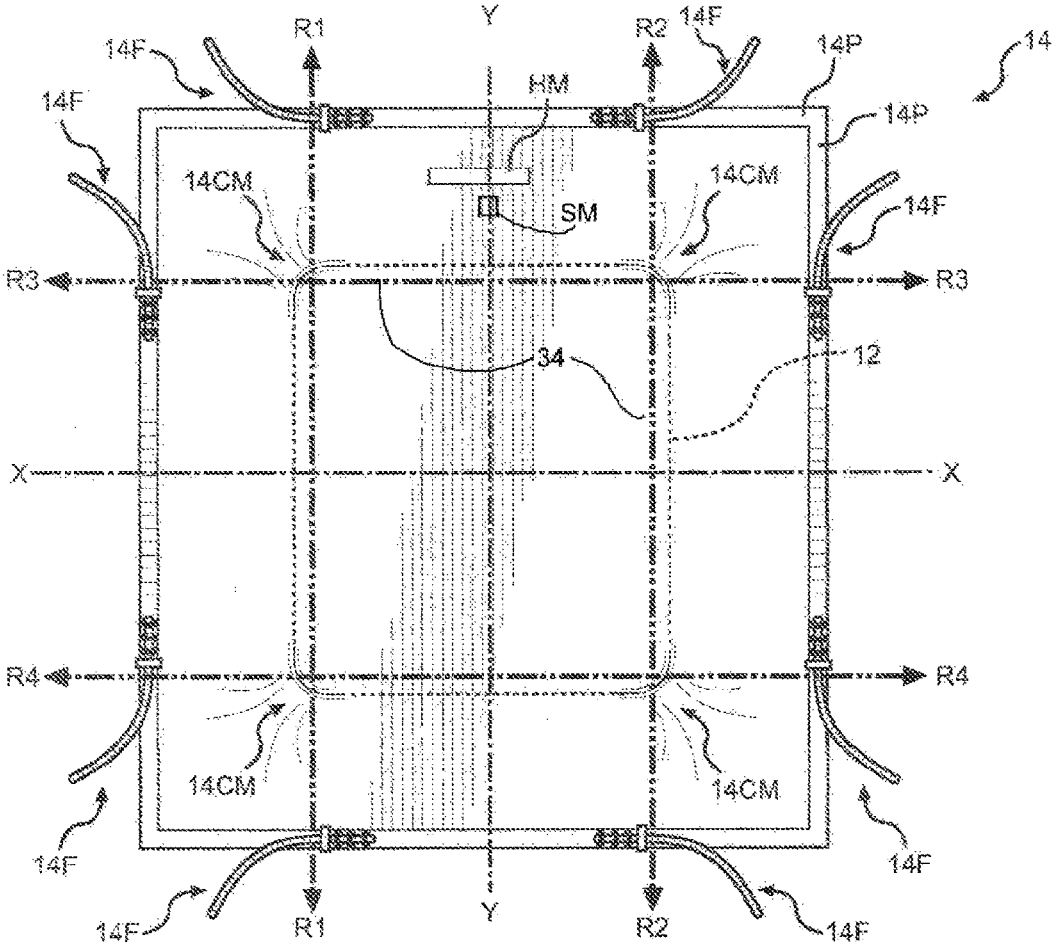
FIG. 3 is a plan view of a rectangular fitted sheet according to a preferred embodiment.

With reference now to FIG. 3, the fitted sheet 14, dimensioned as described in accordance with FIG. 2, has a flat and rectangular shape with the central part 34 and four corners 14C. The fitted sheet 14 is configured to overlie and encase the sides, ends, and upper surface mattress 12, and also snugly engage the corners 12C of the mattress 12 to keep the sheet 14 from slipping off the mattress 12. To facilitate locating the sheet 14 onto the mattress and provide desired orientation of the sheet 14 on the mattress 12, the sheet 14 includes curved corner markers 14CM printed or is otherwise demarcated onto the upper surface 14U and located to overlie the corners 12C of the mattress to enable the sheet 14 to be easily and uniformly centered onto the mattress 12. Location of the corner markers 14CM is described in more detail above in reference to FIG. 1A. The edges of the sheet 14 include a circumferential reinforced perimeter 14P, which is desired for a neat appearance and strength.

Figure 4:
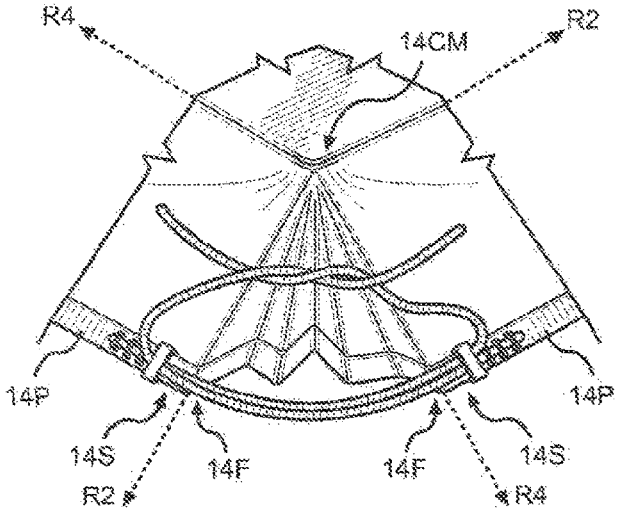
FIG. 4 is a detailed view showing installation of the fitted sheet of FIG. 3 onto a corner of a mattress.
Figure 5:
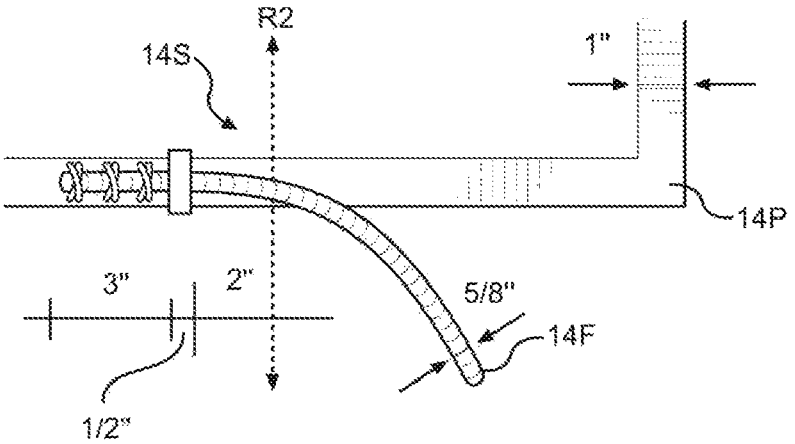
FIG. 5 is a close-up view of a fastener thereof.

To snugly secure the desirably located sheet 14 onto the mattress 12, the sheet 14 includes one or more fasteners 14F proximate each side of each of the corners 14C of the sheet 14, and located at or interior of the reference lines R1-R4. As shown in FIG. 3, and with additional reference to FIGS. 4 and 5, the fasteners 14F are shown provided as strips and loops located on the edges of the sheet 14, each strip being about 12 to 20 inches long and having an outermost sheet engagement location 14S at or interior of the reference lines R1-R4 and secured as by stitches to the reinforced perimeter 14P. Other suitable fasteners include buttons and buttonholes, loops, eyelets, and the like. As shown in FIG. 5, the perimeter 14P provides a channel or sleeve into which the string may be passed. Preferably, the strips and strings are located as the set of three tension points being offset in distance one inch, and next one inch apart respectively interior of the reference lines R1-R4. If desired, a loop may be provided for passage of the strips and strings as shown. The strips of the fasteners 14F are tied together and passed through the loops to snug the sheet 14 about the corners 12C of the mattress and otherwise snugly adjust the sheet 14 to the mattress 12.

As will be observed, provision of an outermost sheet engagement location 14S of the strips FIG. 5 or detachable fasteners (as shown FIGS. 6B, 6C, 6E, 6F) connected respectively to sets three eyelets, buttonholes or loops located on the perimeter, interior of the reference lines R1-R4, (e.g. first eyelet, buttonhole or loop in distance one inch and next one inch apart respectively), ensures a snug fit of the sheet 14 to the mattress 12. Also, as the sheet 14 is tensioned about the mattress 12 by application of the fasteners 14F, the reinforced perimeter 14P becomes positioned below the edges of the mattress 12 to additionally tension and thereby snugly fit the sheet 14 about the mattress 12.

Figure 6A:
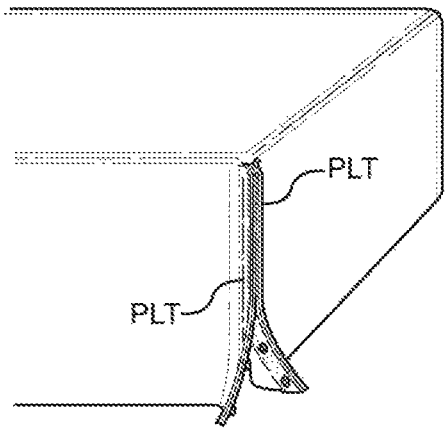
FIGS. 6A-6H show alternate fasteners for use with fitted sheets according to the disclosure.
Figure 6B:
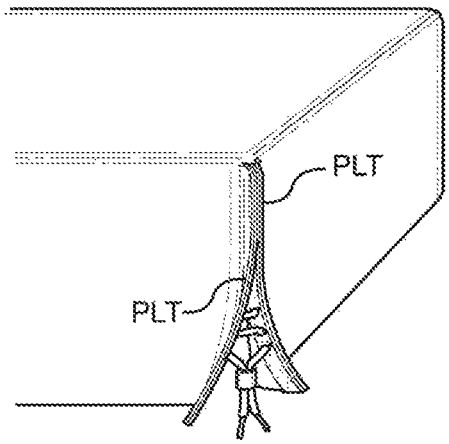
Figure 6C:
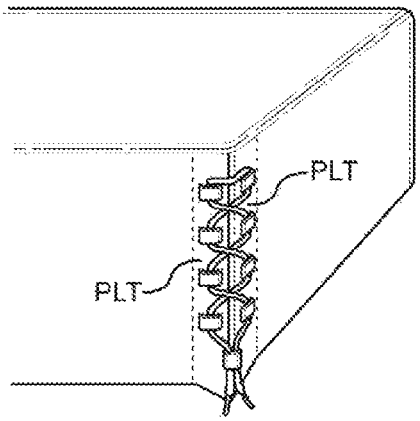
Figure 6D:
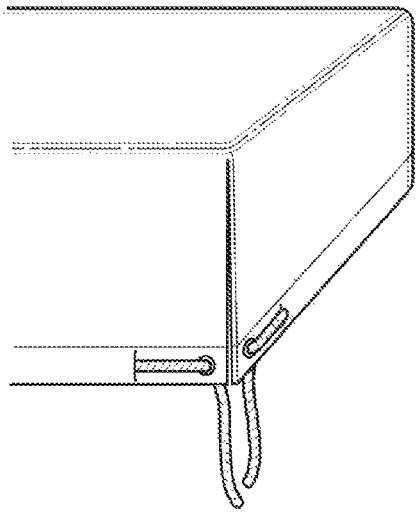
Figure 6E:
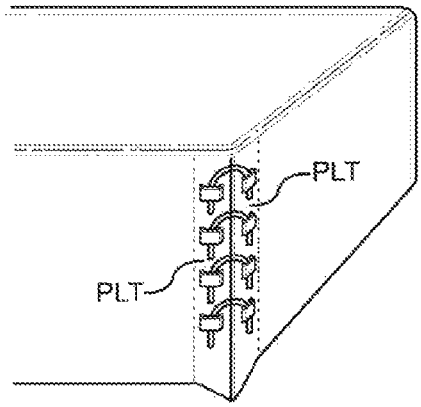
Figure 6F:
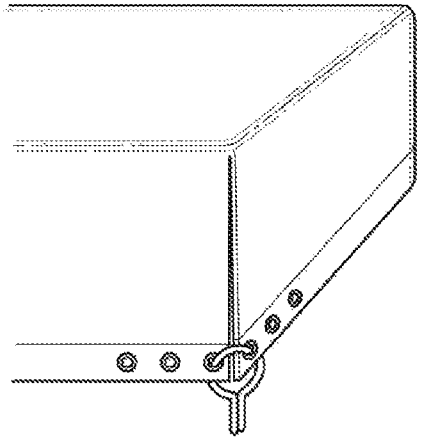
Figure 6G:
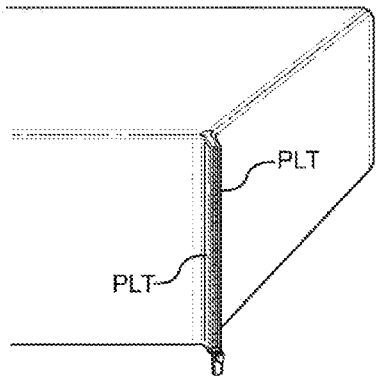
Figure 6H:
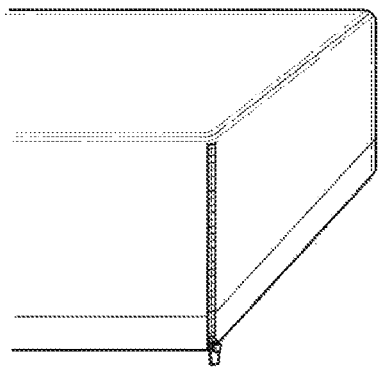
Figure 6I:
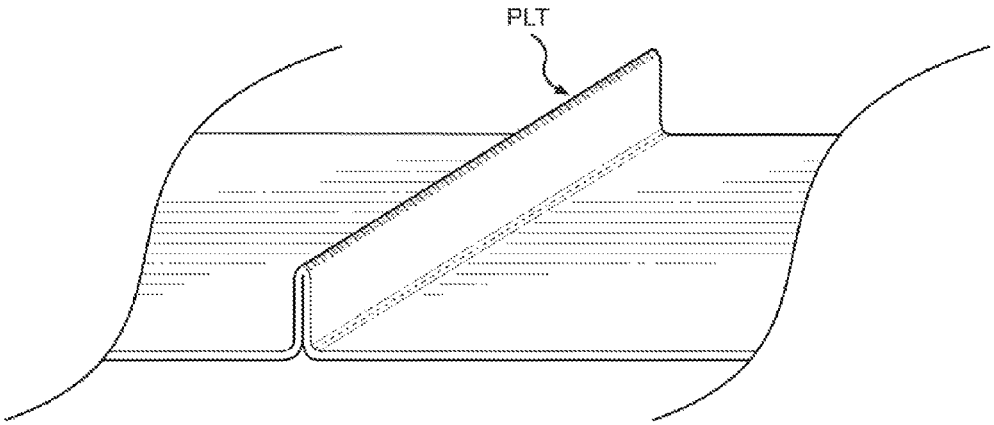
FIG. 6I depicts a pleat formed on a fitted sheet according to the disclosure.

It will be appreciated that various fastener structures may be used instead of or in combination with the strips and strings, and the fasteners 14 F may be provided such as by buttons, hook and loop material, pins, snaps, zippers or other slide fasteners, clasps, and the like. Examples of various other fasteners are shown, for example in FIGS. 6A-6H. It may be preferred for strength to provide a pleat, such as pleat PLT along the locations of the reference lines R1-R4 at the corners of the sheet, and on which the fastener is located. For example, loops may be provided on the pleat PLT for application of fasteners such as clasps, or button holes or the like may be provided through the pleat PLT to receive fasteners. An example of a preferred pleat construction is shown in FIG. 6I, such pleats preferably having a width of about ⅜ inches.

Figure 7:
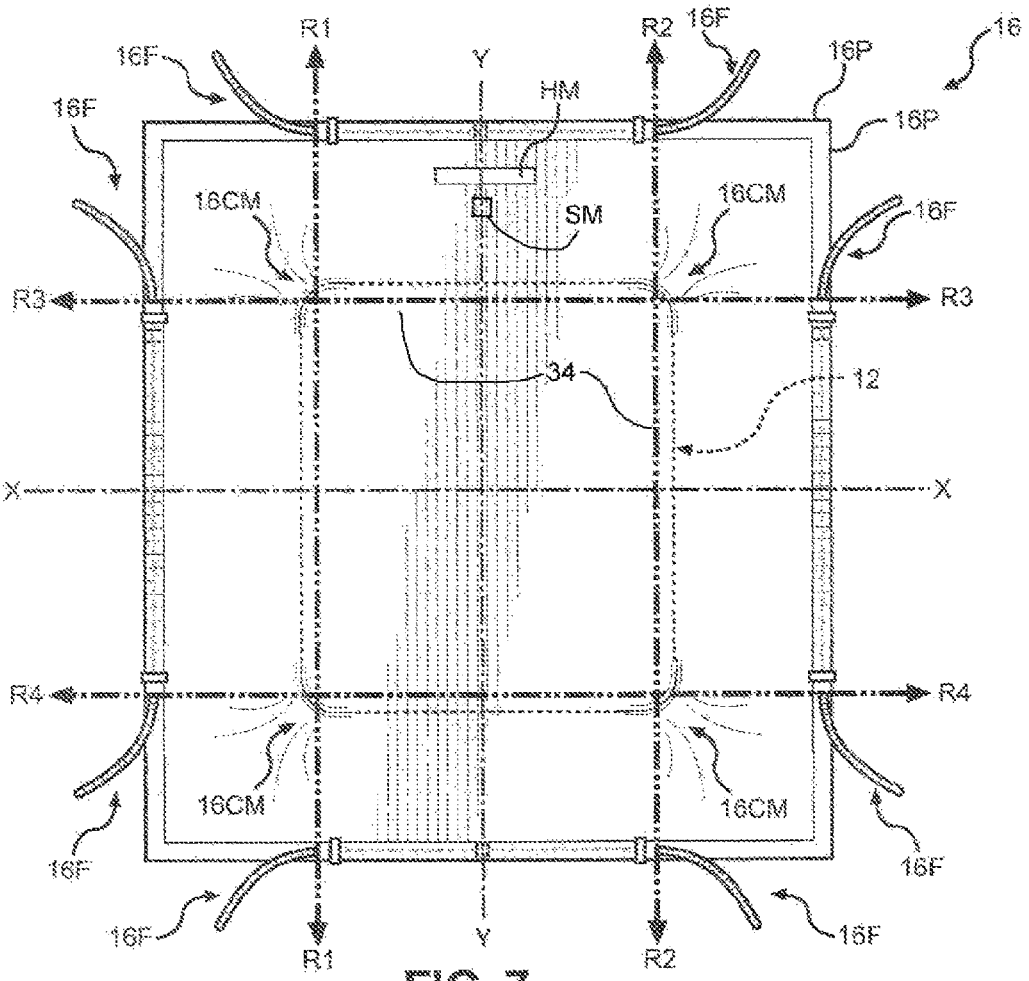
FIG. 7 is a plan view of an alternate embodiment of a rectangular fitted sheet according to the disclosure.
Figure 8:
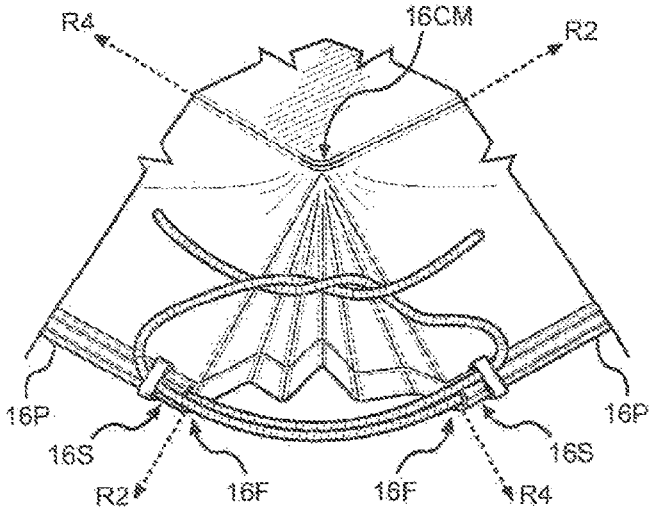
FIG. 8 is a detailed view showing installation of the fitted sheet of FIG. 7 onto a corner of a mattress.
Figure 9:
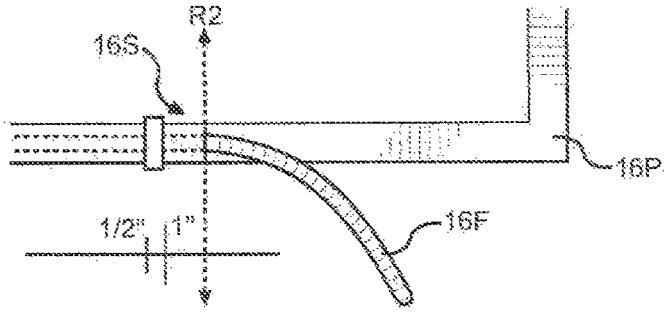
FIG. 9 is a close-up view of a fastener thereof.

With reference now to FIGS. 7-9, the fitted sheet 16, also dimensioned as described in accordance with FIG. 2, has a flat and rectangular shape with four corners 16C. The fitted sheet 16 is configured to overlie and encase the sides, ends, and upper surface mattress 12, and also snugly engage the corners 12C of the mattress 12 to keep the sheet 16 from slipping off the mattress 12. To facilitate locating the sheet 16 onto the mattress 12 and provide desired orientation of the sheet 16 on the mattress 12, the sheet 16 includes curved corner markers 16CM printed or otherwise demarcated onto the upper surface and located to overlie the corners 12C of the mattress to enable the sheet 16 to be easily and uniformly centered onto the mattress 12.

To snugly secure the desirably located sheet 16 onto the mattress 12, the sheet 16 includes one or more fasteners 16F proximate each side of each of the corners 16C of the sheet 16, and having an outermost sheet engagement location 16S at or interior of the reference lines R1-R4. Reinforced perimeter 16P is configured to provide a sleeve or channel and the fasteners 16F continue as an elongate string through the channel to provide another of the fasteners 16F for an adjacent corner 16C of the sheet 16. If desired, stitches may be located to attach the fastener 16F to the reinforced perimeter 16P at one or more locations along the reinforced perimeter 16P (e.g. on the center line Y-Y, and close to the reference line R3). Also, as the sheet 16 is tensioned about the mattress 12 by application of the fasteners 16F, the reinforced perimeter 16P becomes positioned below the edges of the mattress 12 to additionally tension and thereby snugly fit the sheet 16 about the mattress 12.

Figure 10:
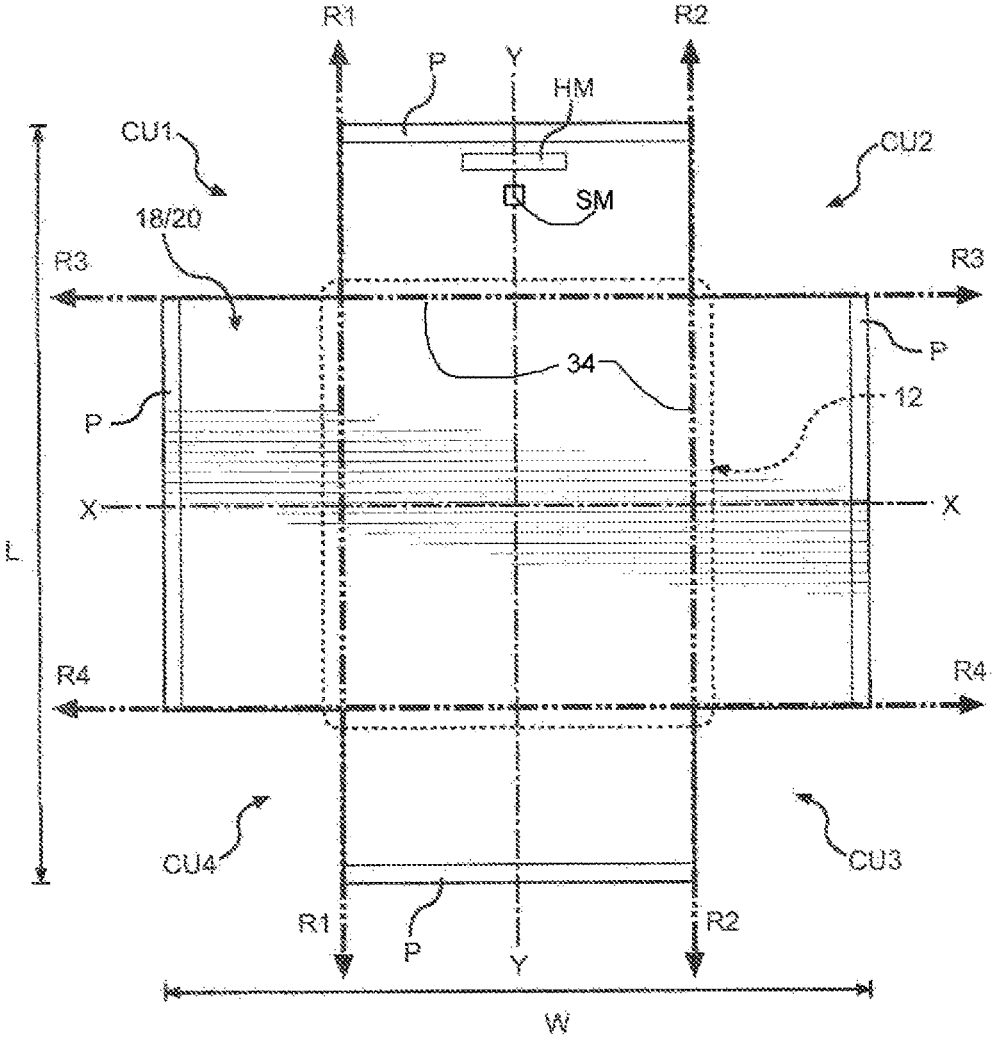
FIG. 10 is a general plan view of fitted sheets having cut-out corners according to the disclosure showing sizing relationships relative to the mattress.

With reference to FIG. 10, the fitted sheets 18 and 20 are each configured to be substantially flat and rectangular, except for having corner cutouts CU1-CU4, and dimensioned to be compatible with the mattress 12. The reference lines R1-R4 correspond to the reference lines R1-R4 described previously in connection with FIG. 2. Each of the cutouts CU is defined by adjacent ones of the reference lines R1-R4. For example, cutout CU1 is provided by removing the square of sheet material outside of the intersection of the reference lines R1 and R3, cutout CU2 by removing the square of sheet material outside of the intersection of the reference lines R2 and R3, cutout CU3 by removing the square of sheet material outside of the intersection of the reference lines R4 and R2, and cutout CU4 by removing the square of sheet material outside of the intersection of the reference lines R4 and R1. The cutouts CU1-CU4 are preferably aligned with the reference lines R1-R4, but may be slightly larger by making the cut lines slightly inside of the reference lines R1-R4. Thus, the cutouts CU1-CU4 are squares having a size of at least as great as the area between adjacent ones of the reference lines R1-R4.

As before, the line X-X designates the lateral center line of the mattress 12 and the line Y-Y designates the longitudinal center line of the mattress 12. In use, the sheet 18/20 is initially positioned on the upper surface of the mattress 12 so that the lateral center lines and the longitudinal center lines of the mattress 12 and the sheet 18/20 overlie one another. Also, the width W and the length L of the sheet 18/20 are the same as described for the sheet 14/16, and include the reinforced perimeter P. The borders of the cutouts CU1-CU4 may also desirably include reinforcement as in the nature of the reinforcing perimeter P and may also include additional closure features, such as button holes and the like, as described more fully in connection with the sheets 18 and 20 below.

Figure 11:
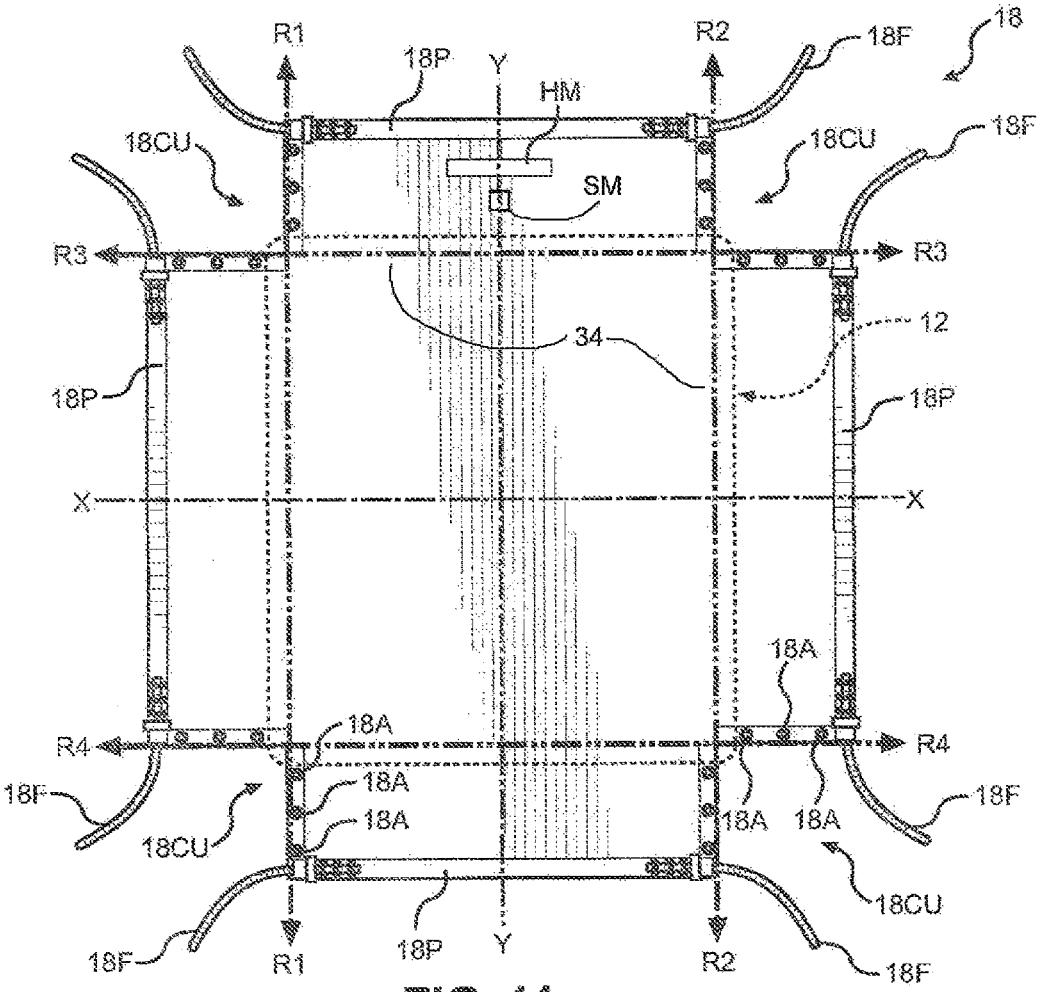
FIG. 11 is a plan view of a fitted sheet having cut-out corners according to a preferred embodiment.
Figure 12:
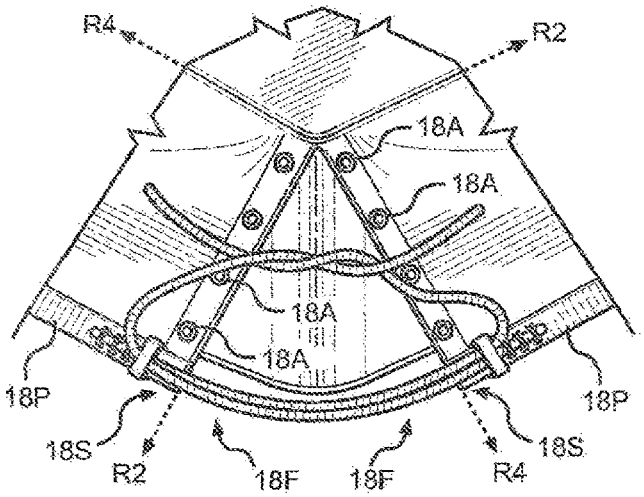
FIG. 12 is a detailed view showing installation of the fitted sheet of FIG. 10 onto a corner of a mattress.
Figure 13A:
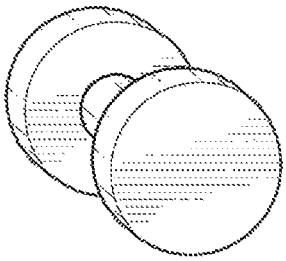
FIGS. 13A-13D show various fasteners for use with fitted sheets according to the disclosure.
Figure 13B:
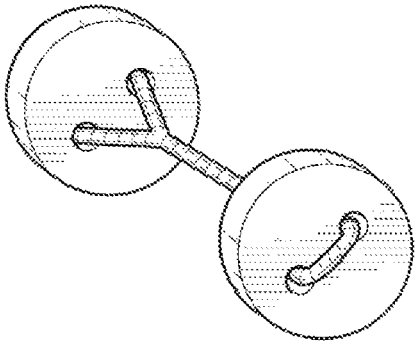
Figure 13C:
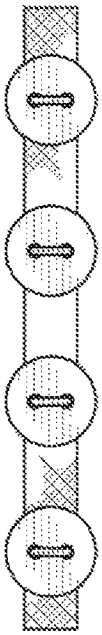
Figure 13D:
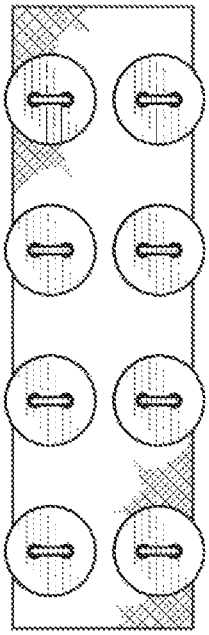

With reference now to FIGS. 11 and 12, the fitted sheet 18 is dimensioned as described in accordance with FIG. 10, has a flat and rectangular shape except for four cutouts 18CU. The fitted sheet 18 is configured to overlie and encase the sides, ends, and upper surface mattress 12, and also snugly engage the corners 12C of the mattress 12 to keep the sheet 18 from slipping off the mattress 12. The edges of the sheet 18 include a reinforced perimeter 18P.

To snugly secure the desirably located sheet 18 onto the mattress 12, the sheet 18 includes one or more fasteners 18F proximate each side of each of the cutouts 18CU of the sheet 18, and having an outermost sheet engagement location 18S at or interior of the reference lines R1-R4. The fasteners 18F and sheet engagement locations 18S are similarly to the fasteners 14F and sheet engagement locations 14S described above in connection with the sheet 14. In addition, apertures 18A are located along the preferably reinforced edges of the cutouts 18CU for locating detachable fasteners. In this regard, FIGS. 13A-13D show examples of detachable fasteners that may be detachably mated on the sheet 18 using the apertures 18A on each side of the cutout 18CU. Also, as the sheet 18 is tensioned about the mattress 12 by application of the fasteners 18F, the reinforced perimeter 18P becomes positioned below the edges of the mattress 12 to additionally tension and thereby snugly fit the sheet 18 about the mattress 12.

Figure 15:
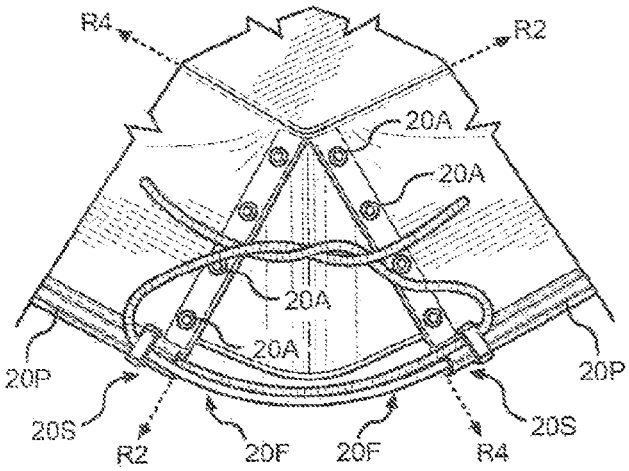
FIG. 15 is a detailed view showing installation of the fitted sheet of FIG. 14 onto a corner of a mattress.

With reference now to FIGS. 14 and 15, the fitted sheet 20 is dimensioned as described in accordance with FIG. 10, has a flat and rectangular shape except for four cutouts 20CU. The fitted sheet 20 is configured to overlie and encase the sides, ends, and upper surface mattress 12, and also snugly engage the corners 12C of the mattress 12 to keep the sheet 20 from slipping off the mattress 12. The edges of the sheet 20 include a reinforced perimeter 20P.

To snugly secure the desirably located sheet 20 onto the mattress 12, the sheet 20 includes one or more fasteners 20F proximate each side of each of the cutouts 20CU of the sheet 20, and having an outermost sheet engagement location 20S at or interior of the reference lines R1-R4. The fasteners 20F and sheet engagement locations 20S are similarly to the fasteners 16F and sheet engagement locations 16S described above in connection with the sheet 16. In addition, apertures 20A are located along the preferably reinforced edges of the cutouts 20CU for locating detachable fasteners, such as those shown in FIGS. 13A-13D. Reinforced perimeter 20P is configured to provide a sleeve or channel and the fasteners 20F continue as an elongate string through the channel to provide another of the fasteners 20F for an adjacent corner 20C of the sheet 20. If desired, stitches may be located to attach the fastener 20F to the reinforced perimeter 20P at one or more locations along the reinforced perimeter 20P (e.g. on the center line Y-Y, and close to the reference line R3). Also, as the sheet 20 is tensioned about the mattress 12 by application of the fasteners 20F, the reinforced perimeter 20P becomes positioned below the edges of the mattress 12 to additionally tension and thereby snugly fit the sheet 20 about the mattress 12.

Figure 16:
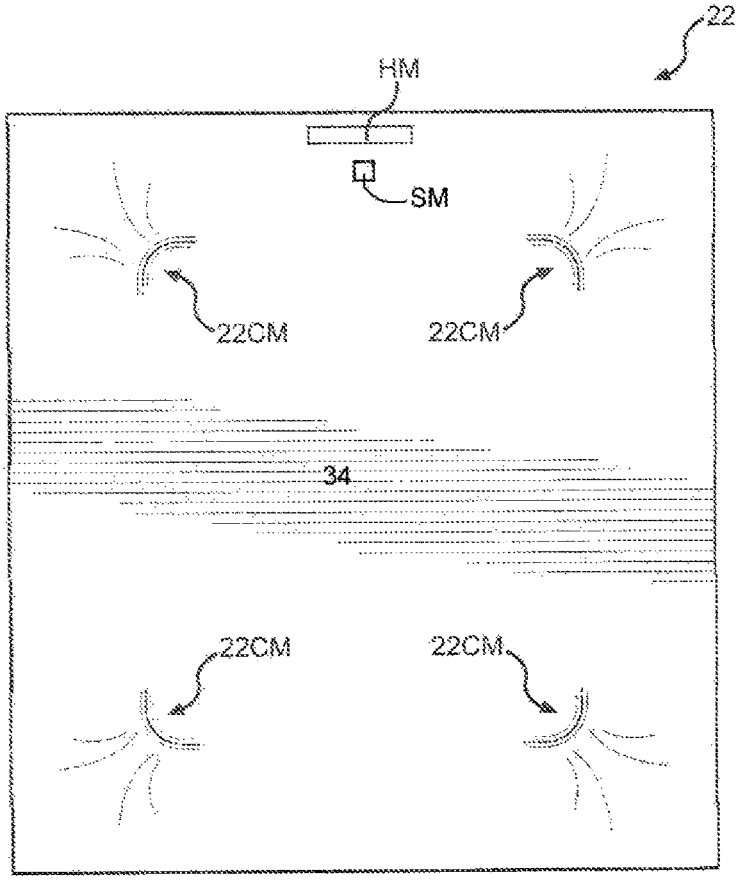
FIG. 16 is a plan view of a flat sheet according to the disclosure.
Figure 17:
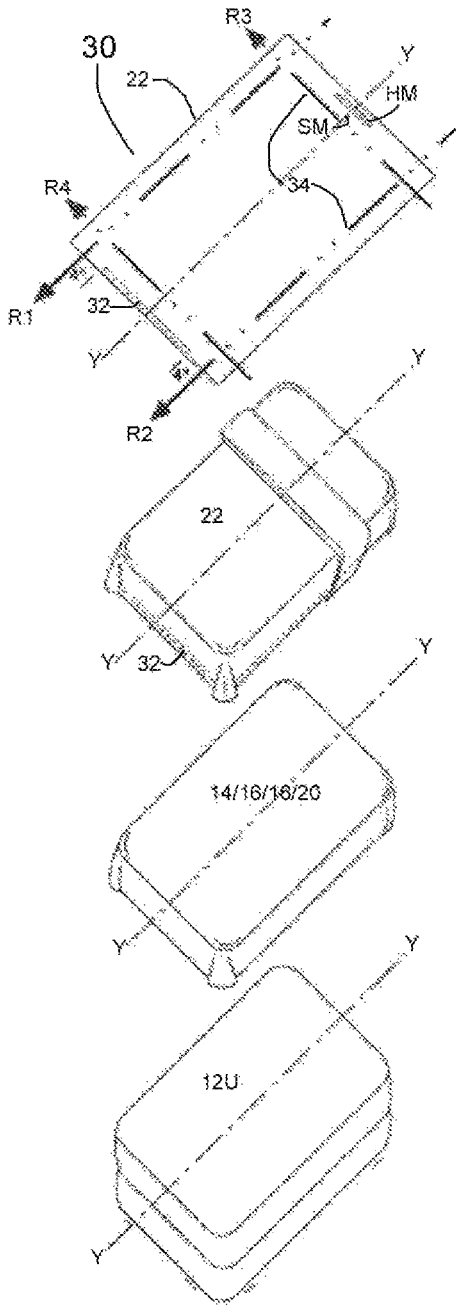
FIGS. 17-20 show another embodiment of a sheet system according to the disclosure.
Figure 18:
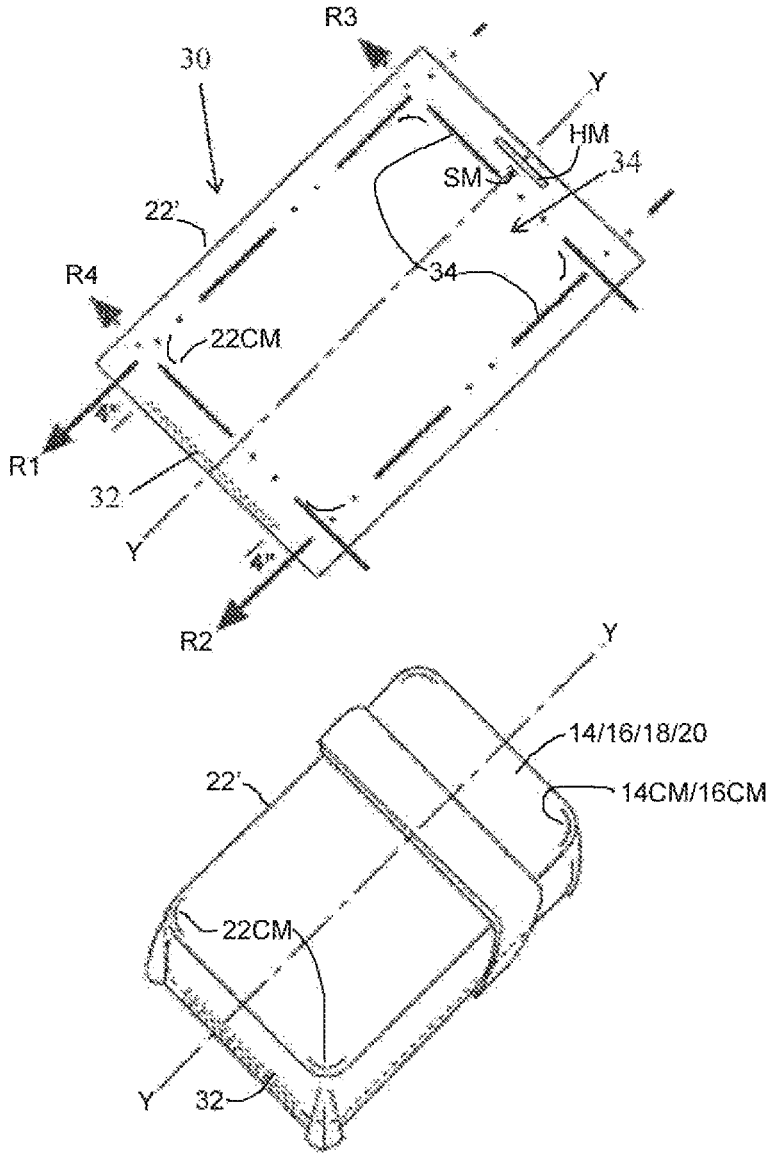
Figure 19:
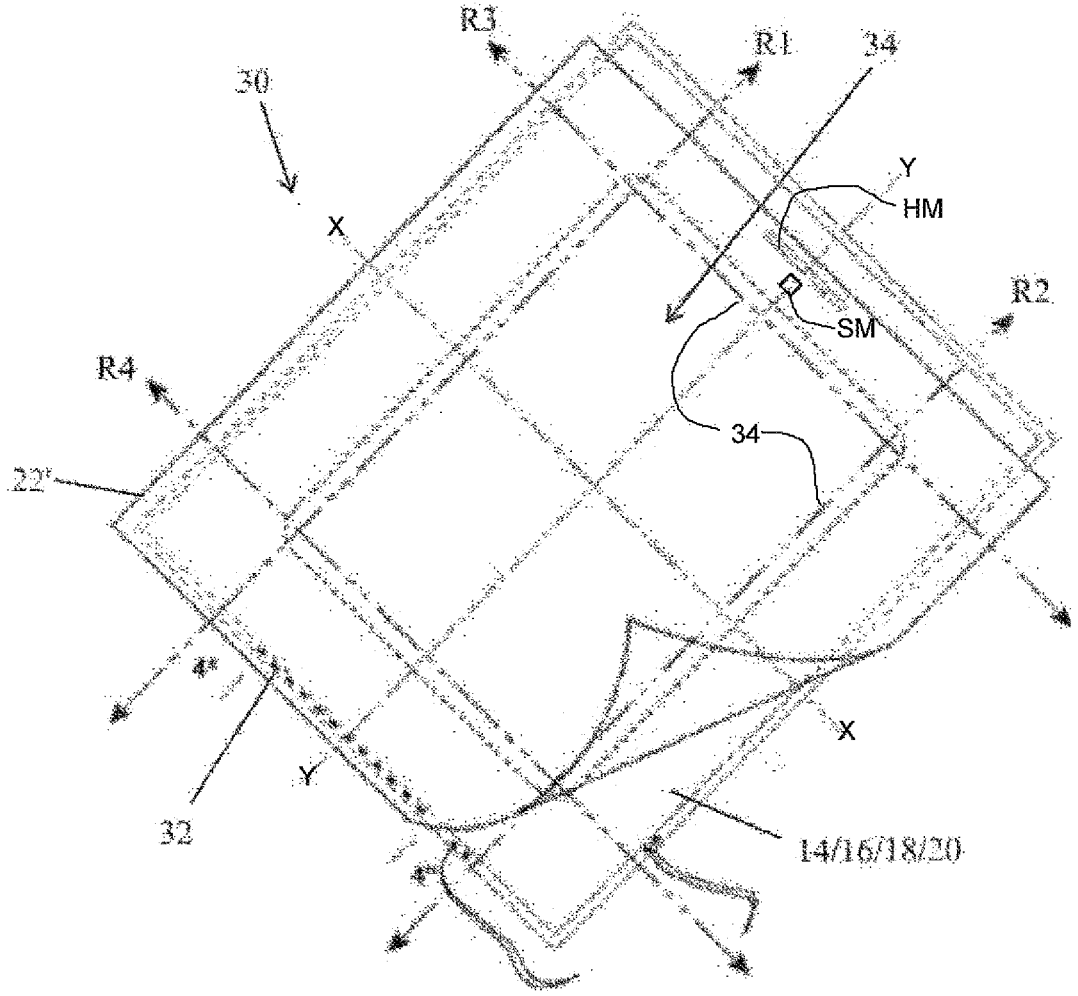
Figure 20:
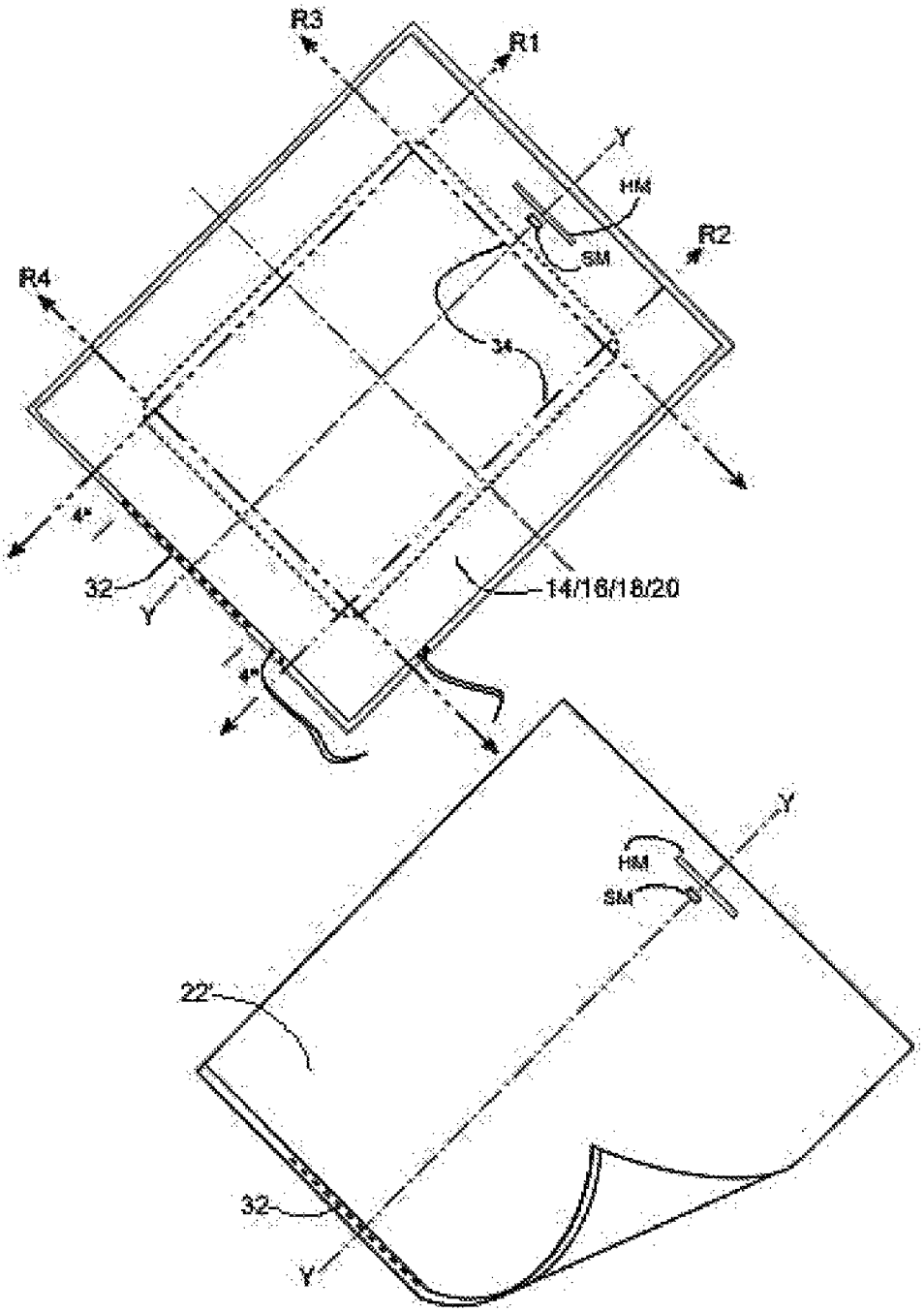

With reference now to FIG. 16, the unfitted top flat sheet with standard dimension flat sheet 22 is compatible with and overlies the fitted sheets 14/16/18/20 as shown in FIG. 1. The flat sheet 22 is substantially rectangular and compatible with the mattress 12. The standard dimension flat sheet 22 preferably includes curved corner markers 22CM printed or is otherwise demarcated onto the upper surface and located to overlie the corners 12C of the mattress to enable the sheet 22 to be easily and uniformly centered onto the mattress 12. The location of the corner markers 22CM is the same as that for the corners markers 14CM and 16CM, and described above in reference to FIG. 1A. The standard dimension flat sheet 22 includes size-marker and head-marker located adjacent a head-end of the sheet 16.

With reference to FIGS. 17-20, there is shown an alternate embodiment of a bed sheet system 30. The system 30 corresponds to the previously described system 10, except it includes a standard dimension flat sheet 22'. The flat sheet 22' corresponds to the flat sheet 22, except the flat sheet 22' is physically attached to the underlying fitted sheet 14/16/18/20, as by fastening raw 32. As seen, the fitted sheets have a central part 34 defined and confined by the reference lines R1-R4.

In this regard, the spacing of the attachment standard dimension top flat sheet 22' to the bottom fitted sheet at the foot-hem or reinforced perimeter P is 4 inches off the reference lines R1 and R2, interior, on the hem. The attachment of the top flat sheet 22' to the fitted sheet may be accomplished such as by sewing or other non-detachable attachment. The attachment may also be detachable, as by buttonholes spaced equally on the foot-hem and flat sheet with the detachable fasteners, such as shown in FIGS. 13A-13D, snaps, zippers, or other detachable fasteners.

The bottom fitted sheet is installed and snugly fit onto the mattress by applying pressure to the fitted sheet by pulling together fasteners located at tension points on the reinforced hem of the bottom flat-fitted sheet, as the set of three tension points, being offset in distance one inch, and next one inch apart respectively off the reference lines interior, to secure fasteners in position on the sheet. Application of the pressure by pulling causes the length of curved edges of the physical top of the mattress to transform to the rectangular shape of the central part of the fitted sheet. This creates three-dimensional compression on the mattress and tension at the locations of the fasteners to provide additional tension around the elastic mattress to cause reinforced perimeter of the bottom fitted sheet to slip under corners of the mattress to aid in maintaining the fitted sheet in compression on the mattress and aid in inhibiting the fitted sheet from slipping off the mattress. The structure and installation of bottom fitted sheets according to the disclosure advantageously produce a compression on the top of the mattress by the central part 34 of the fitted sheet and tension on the reinforced perimeter or hem of the sheet.

FIGS. 1A, 1B, 1C also show additional explanation as to how the tension of the fitted sheets 14/16/18/20 is accomplished and construction thereof. Geometry formulas and calculations for the structure and size of the fitted sheets 14/16/18/20 and the relation to the nominal dimensions of the mattress are shown. It will be understood that for the mattress 12W=width; 12L=length; 12H=height. For the fitted sheet, W=sheet width; L=sheet length; The width of the reinforced perimeter of the sheet, or the hem is equal to one inch. The width W of the fitted bed sheet is equal: (central part' width as nominal width of mattress 12W reduced two inches) plus (two times nominal height of mattress with addition two inches for reinforced perimeter). The length L of the fitted bed sheet is equal: (central part' length as nominal length of mattress 12L reduced two inches) plus (two times nominal height of mattress with addition two inches for reinforced perimeter).

Calculation of the construction of the sheet is shown in Example 1:

Example 1

A) In order to make the fitted sheet, the construction has to start from the, transverse and longitudinal to calculate the reference lines of the central part:

Left side=Centerline (transverse)+[½ of (12*W* nominal mattress−1")]

Right side=Centerline (transverse)+[½ of (12*W* nominal mattress−1")]

Upper side=Centerline (longitudinal)+[½ of (12*L* nominal mattress−1")]

Lower side=Centerline (longitudinal)+[½ of (12*L* nominal mattress−1")]

B) central part 34 plus height of SIDES, ENDS (12H nominal mattress plus one inch hem);

C) size of the flat fitted sheet:

Width=(12*W* nominal mattress−2")+(2×12*H* nominal mattress+2×1" hem);

Length=(12*L* nominal mattress−2")+(2×12*H* nominal mattress+2×1" hem)

The foregoing description of preferred embodiments for this disclosure have been presented for purposes of illustration and description. They are not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A bed sheet system for application to an elastic mattress, the mattress having a size; a mattress top having a perimeter; four rounded mattress corners at corners of the mattress, each mattress corner having a radius; a nominal mattress width between opposite sides of the mattress on a transverse axis of the mattress; a nominal mattress length between opposite ends of the mattress on a longitudinal axis of the mattress; and a nominal mattress height defined by the distance between a top and a bottom of the mattress, the bed sheet system comprising:

a bottom fitted sheet comprising a rectangular non-elastic fabric panel configured for covering the mattress and exerting compression on the mattress when installed thereon; and a top unfitted sheet comprising a rectangular fabric panel for overlying the fitted sheet when installed thereon for covering the mattress and the fitted sheet;

wherein the fitted sheet construction comprises four crease reference lines located to be parallel to the longitudinal and transverse axes of the mattress and located one inch in distance from rectilinear edges of the mattress and parallel to the longitudinal and transverse axes of the mattress when installed on the mattress, the four crease reference lines defining on the fitted sheet a rectangular unitary central part, two ends, and two sides and four corners, the corners being removable or non-removable;

wherein two of the crease reference lines define width reference lines, each width reference line of the central part located when the fitted sheet is applied to the mattress so as to be parallel to one of the sides of the mattress and spaced a distance inside a side of the mattress an amount equal to at least the difference of the [radius of mattress minus (π·radius of the mattress/4)], and two of the crease reference lines define length reference lines, each length reference line of the central part located when the sheet is applied to the mattress so as to be parallel to one the sides of the mattress and spaced a distance inside an end of the mattress an amount of at least the difference of the [radius of mattress minus (π·radius of the mattress/4)];

wherein the rectangular central part of the fitted sheet is dimensioned to have a width two inches less than the nominal width of the mattress and a length two inches less than the length dimensions of the mattress, the rectangular central part having a perimeter equal to the perimeter of the mattress top, the rectangular central part defined and confined by the reference lines, the central part's extended crease reference lines defining three alternative fastener positions for location of fasteners with a fastener being provided at each fastener position for installation thereon during fitting of the fitted sheet to the mattress;

wherein the fitted sheet is configured in size for each size of mattress by calculation of the central part as a rectangle having sides that are each two inches smaller than corresponding sides of the mattress plus two ends-wings and two sides-wings, which equal the nominal height of the mattress plus one inch for the reinforced perimeter-hem;

wherein the three alternative fastener positions on ends of the reinforced perimeter, enclosed between reference lines, defined by the extended crease reference lines of central part, are located adjacent a corner of the mattress and located to be first point one-inch interior and second point and a third point each being one inch apart respectively, for the adjustment of the tension, interior of one of the width reference lines or interior of one of the length reference lines;

wherein so when the fasteners are installed at the fastener positions the fitted sheet is snugly fit onto the top of the mattress and applies pressure to curved edges of the top of the mattress proximate the corners to transform the curved edges to a rectangular shape corresponding to the central part of the fitted sheet, which creates a primary compression on the top of the mattress and a secondary tension at the fastener positions to provide additional tension around the mattress to cause lower edges of the fitted sheet to slip under the mattress to aid in maintaining the fitted sheet in compression on the mattress and aid in inhibiting the fitted sheet from slipping off the mattress;

wherein a bottom fitted sheet including a head-marker, a size marker defined on a head end of the top fitted sheet at a longitudinal axis thereof, and demarcated corner marks of the underlying mattress and located to overlie the intersection of crease reference lines to facilitate positioning the bottom fitted sheet on the mattress in centered position; and the top unfitted sheet being configured for overlying the fitted sheet when installed thereon for covering the mattress and the fitted sheet, the top unfitted sheet comprising a rectangular panel of fabric with a doubled edge on a foot hem thereof, and having layout guiding thereof for the transverse and longitudinal axes, comprising a head-marker and size-marker defined on a head end of the top unfitted sheet at longitudinal axis thereof, and corner marks of the underlying mattress defined on the top unfitted sheet and located to overlie the crease reference lines of the fitted sheet when the top unfitted sheet is laid over the unfitted sheet to facilitate positioning of the top unfitted sheet in a centered position on the mattress so that with substantially equal portions of the unfitted sheet overhang each side of the mattress;

wherein the top unfitted sheet is attached along the foot-hem thereof to the underlying fitted sheet foot hem by a fastening row having opposite ends each located a distance of four inches from the length reference lines of the fitted sheet, wherein the fastening row is either sewed to the unfitted sheet or attached thereto with detachable fasteners.

* * * * *